US006817843B2

(12) United States Patent
Leising et al.

(10) Patent No.: US 6,817,843 B2
(45) Date of Patent: Nov. 16, 2004

(54) BALL CHECK AIR VENT FOR TRANSMISSION PUMP

(75) Inventors: Maurice Leising, Clawson, MI (US); Charles Redinger, Macomb, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/310,787

(22) Filed: Dec. 6, 2002

(65) Prior Publication Data

US 2004/0109774 A1 Jun. 10, 2004

(51) Int. Cl.[7] ..... F04B 49/00
(52) U.S. Cl. ..... 417/310; 417/440; 418/170
(58) Field of Search ..... 417/435, 440, 417/310; 418/170, 171; 60/357, 358

(56) References Cited

U.S. PATENT DOCUMENTS 2,776,630 A * 1/1957 Fagan ..... 417/435
2,915,015 A * 12/1959 Erikson et al. ..... 417/435
3,063,245 A * 11/1962 Rippy ..... 60/336
3,238,726 A * 3/1966 Jandasek ..... 60/348
3,901,628 A * 8/1975 Bornholt et al. ..... 417/310

* cited by examiner

*Primary Examiner*—Charles G. Freay
(74) *Attorney, Agent, or Firm*—Ralph E. Smith

(57) ABSTRACT

A pressure-relieving valve is connected to relieve air pressure from an internal diameter of a transmission pump. On startup, pressurized oil is delivered to the torque converter. At engine idle speed, the centrifugal effects on the oil cause any air (which may have leaked into the torque converter during the shut-down time) to accumulate at the center of the converter. Air pressure output from a torque converter escapes between the housing and the transmission pump to which it is connected. The escaped air reaches the internal diameter of the pump and it is prevented from blowing across the face of the pump to the suction side of the pump by a ball and check valve arrangement which delivers the air to a non-fluid internal part of a transmission, thereby avoiding the leakage of this air to the suction side of the pump and the possible loss of pump prime.

10 Claims, 4 Drawing Sheets

BALL CHECK AIR VENT FOR TRANSMISSION PUMP

BACKGROUND AND SUMMARY OF THE INVENTION

The present invention is related to an improved system for managing air build-up in a transmission oil pump during shutdown of the vehicle.

The flow of transmission fluid through and around a torque converter and transmission is especially sensitive to fluid leaks due to aging of the bushing or other sealed areas. These leaks can eventually cause an interruption of smooth operation between the engine, the torque converter and the transmission.

These problems are often exacerbated during start-up of a vehicle. Ironically, the problems on start-up are often caused by the problems arising after shutdown of the vehicle. A torque converter is ideally fitted with a check valve to keep the torque converter full of fluid when the engine is shut down. However, because of leaks in the bushings or other scaling surfaces, a fluid path can be created to drain transmission fluid out of the converter and back into the transmission. The effect of such drain over time, when the transmission is shut off, is to make the transmission feel as though it is slipping during initial takeoff when the engine is restarted. This slipping can occur over a period of several seconds and is certainly a cause of consumer complaint.

In order to understand how this slow takeoff or slipping occurs because of transmission leaks, it is necessary to understand the relationship between the transmission pump and the torque converter vis-a-vis the fluid flow upon start-up in a transmission and a torque converter.

FIG. 1 illustrates start-up pressure to include the clutch pressure and the transmission pump pressure which, as illustrated, immediately or rather quickly ramps up to operating pressure. On the other hand, the torque converter input pressure increases more gradually than the pump pressure and the torque converter output pressure reaches its peak value on a slope similar to the torque converter input pressure.

All of these pressures, in an ideal situation are transmission fluid pressures. However, in the above discussed leakage problem where fluid drains out of the converter and into the transmission, the pressure illustrated by the torque converter output is partially an air pressure. Because this is air pressure, it can easily escape into or blow-by the face of the transmission pump. If the transmission pump were perfectly machined with the housing, the air would not be able to blow across the face of the pump. However, as a transmission pump and housing may be entirely adequate to prevent leakage of fluid, it can still allow the air to blow across the face of the pump. Having the air blow across the face of the pump has the effect of washing out fluid which is used to prime the pump on start-up. It also alters the path for the air discharge from the pressure side of the pump and becomes a source of air to feed the suction side of the pump. In effect, this buildup of air pressure at the ID (inside diameter) of the transmission pump causes the aforementioned slipping in the transmission upon initial takeoff for a number of seconds. In other words, the transmission pump should be primed with transmission fluid for an immediate "takeoff." However, because of the washing away of this fluid by the air pressure buildup which has leaked into the ID of the transmission pump, there is no effective noncompressible primer for the pump so that it delays pressure build up and causes the resultant slippage.

It is an object of the present invention to provide an arrangement to solve this slippage problem.

It is a particular feature of the present invention that the slippage of the transmission is prevented by a controlled release of air pressure built up at the ID of the transmission pump.

The objects of the present invention are accomplished by the use of a properly sized and positioned ball check air valve arrangement position between the ID of the transmission pump and the inside non-fluid containing areas of the transmission.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
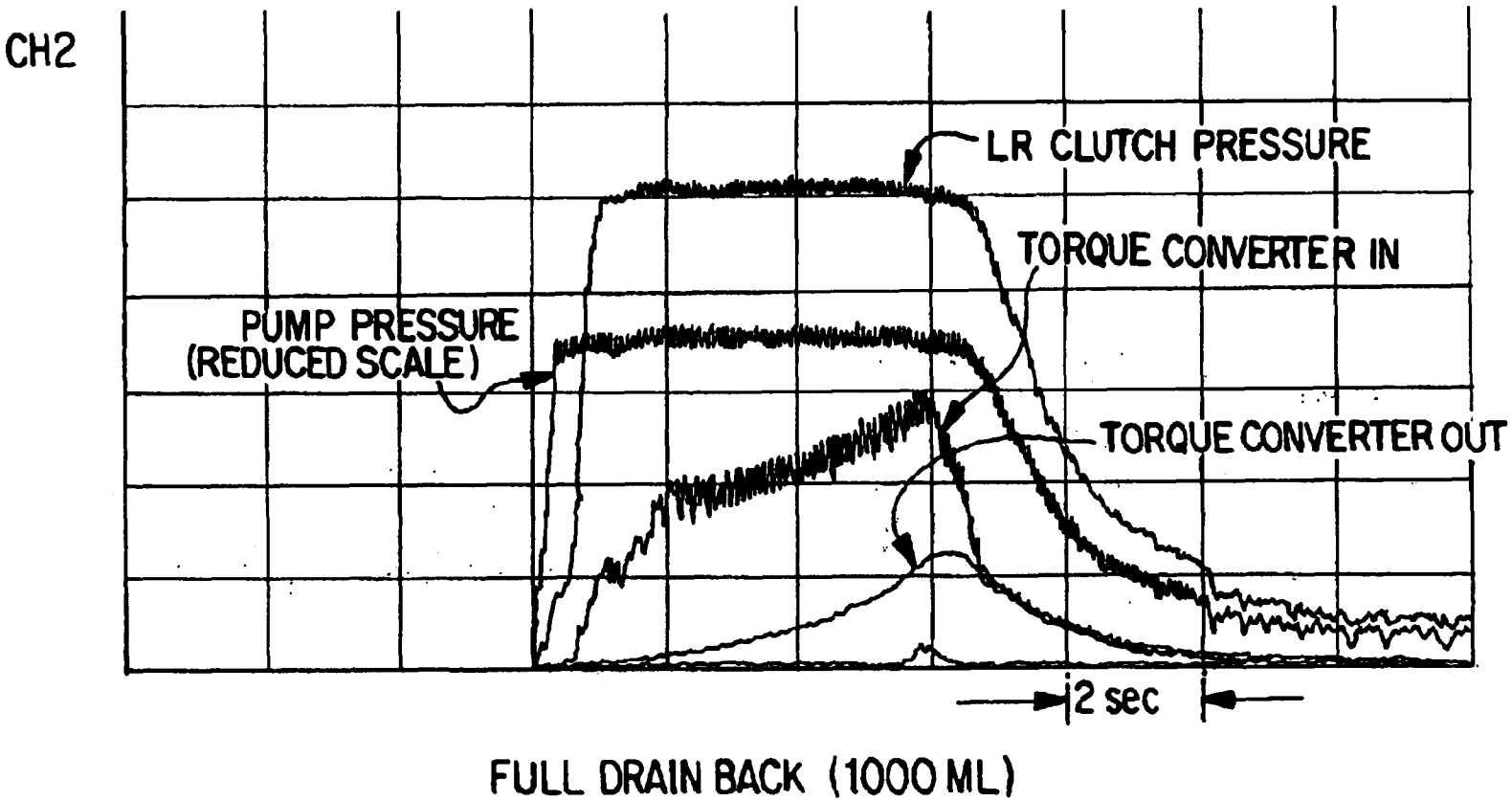
FIG. 1 is a graph of torque converter clutch and pump pressures during start-up of a vehicle.
Figure 2:
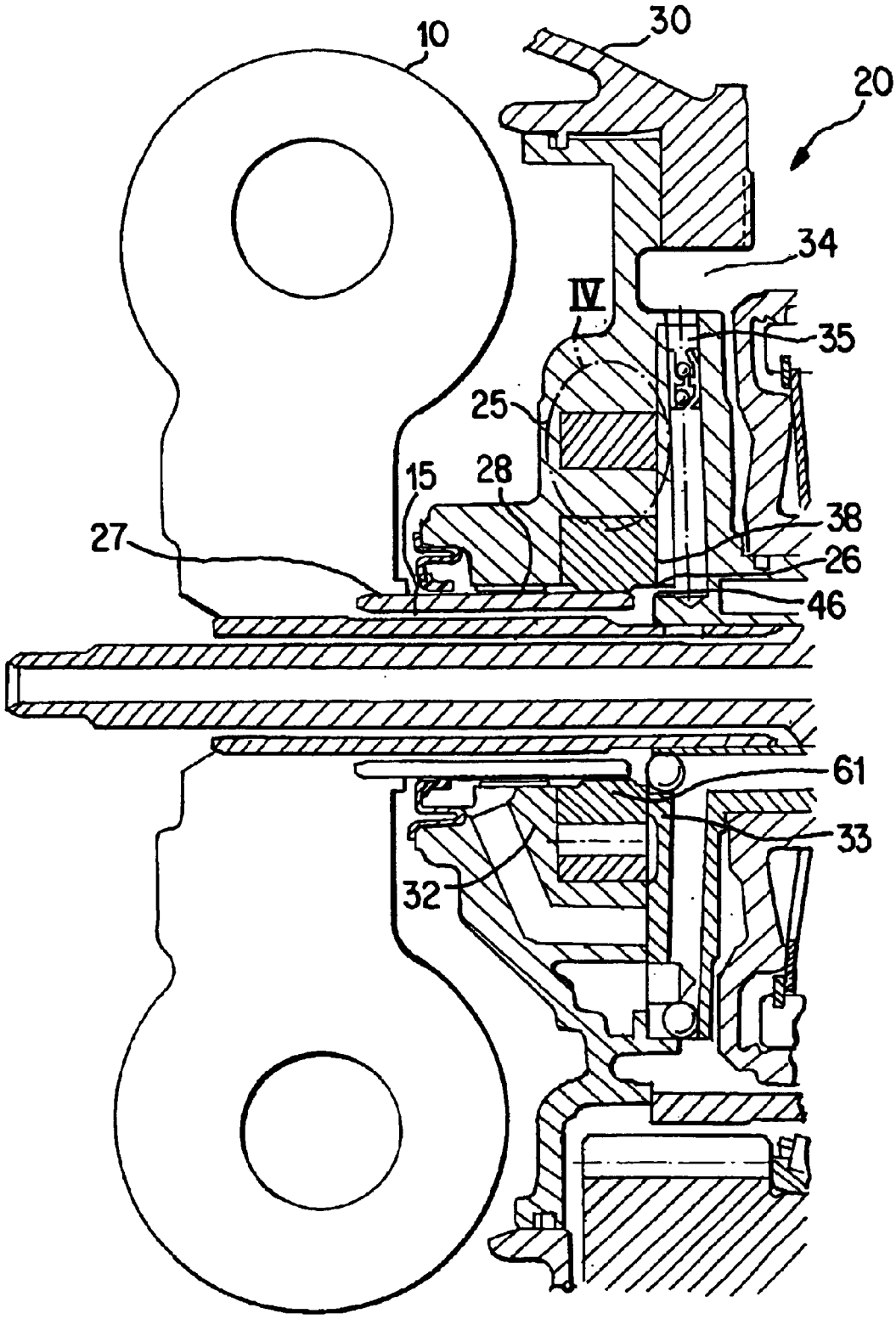
FIG. 2 illustrates a torque converter, transmission housing and transmission pump with the ball check valve according to the present invention.

A torque converter 10 is shown in FIG. 2 connected to a transmission 20 inside the housing 30. The transmission 20 includes a transmission gear pump 25 having an ID (internal diameter) portion 26. The internal diameter portion 26 has fluid communication with the torque converter 10. Passage 15 provides the fluid communication with the internal diameter of the pump (portion 26). During shut-down, however, due to spacing between the pump bushing 28 and the torque converter hub 27, and spacing between the pump inner rotor, 61 and the pump housings 32, 33, air can leak into the internal diameter portion 26. The ball check valve arrangement 35 shown in FIG. 2 is positioned between the ID portion 26 of the transmission pump and the internal cavity of the transmission 20. This air bleed passage construction of a ball check valve serves to retain transmission fluid under pressure but allows pressurized air to escape from the ID portion 26 of the transmission pump 25 into the non-fluid area 34 of the transmission.

Figure 3:
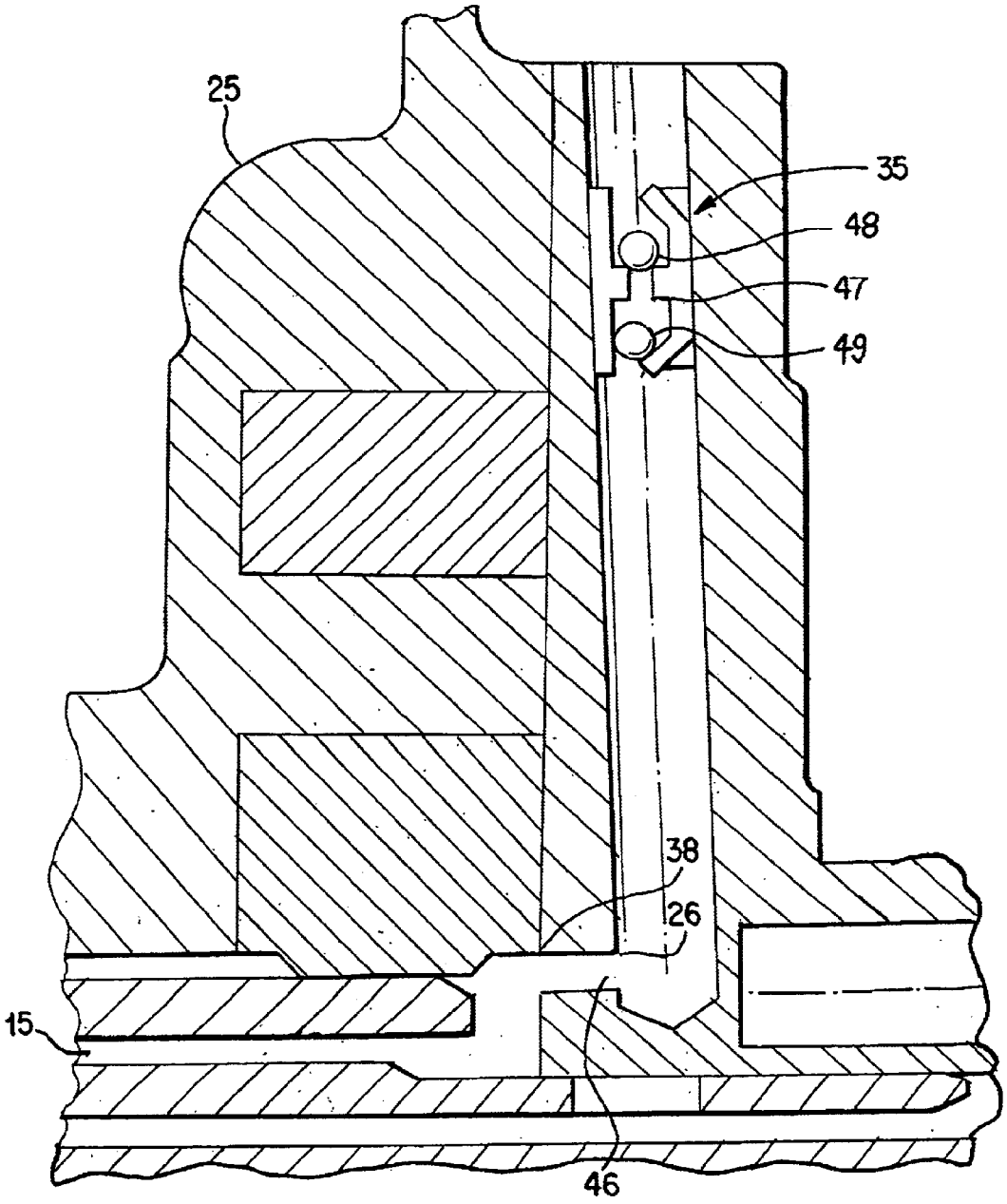
FIG. 3 is a detailed view of a ball check valve used in the arrangement of FIG. 2.

Under ideal conditions, any air at the torque converter output would be fed through the torque converter out circuit and eventually to the internal cavity of the transmission 20. On the other hand, because of spacing tolerances 38 between the pump and the housing, it is also possible for air to escape into the internal diameter of the gear pump where it blows across the face of the pump and into the suction side of the pump. When air enters the suction side it expands and compresses rather than being forced through the pump as liquid would. As a result, there is a significant lag in pressure build up due to the air on the suction side of the pump. As illustrated in FIG. 2, an air bleed passage 46 intercepts air at the internal diameter of the gear pump and outputs the air through the check valve 35 to a non-fluid portion 34 of the transmission. As detailed in FIG. 3, the pressure relief valve 35 is in the form of a ball check valve wherein a lower ball 49 is seated on the lower valve and is dimensioned to allow air to pass around the ball and at the same time to not allow fluid to pass around the ball. Upon an increase in fluid pressure, the ball 49 will rise up to the top position 47 to shut off all leakage. The second or upper ball 48 mainly functions to keep air from the non-fluid area 34 of the transmission from leaking back into the ID portion 26 of the pump when the engine is shut off.

While a particular ball check valve is illustrated, other pressure release mechanisms may be employed as long as they are able to allow the passage of air but not transmission fluid and as long as they operate to relieve air pressure from the internal diameter of the pump, thereby preventing the air from blowing across the face of the pump.

Figure 4:
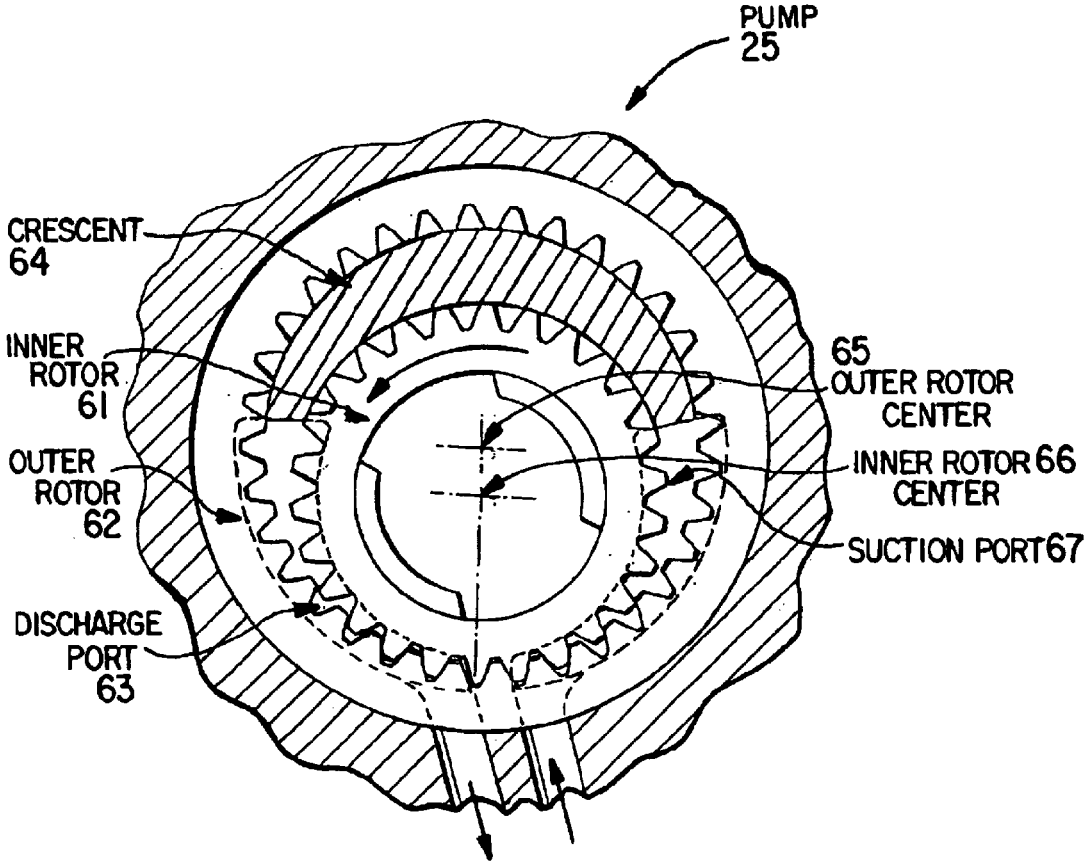
FIG. 4 is a cross-section of the gear transmission pump of FIG. 2.

The particular gear pump 25 used as the transmission pump of FIG. 2 is shown in cross-section in FIG. 4. Pump 25 has inner rotor/device gear 61 and outer rotor/internal gear 62 with respective inner and outer centers (66, 65). The two gears mesh on one side of the pump between the suction port 67 and discharge port 63. On the opposite side of the pump, a crescent is form fitted to fill space between the two gears. The rotation of the center gear by the drive shaft causes the outer gear to rotate, whereas, the crescent remains stationary. This causes liquid to be trapped in the gear space as it passes the crescent. The liquid is carried from the suction portion 67 to the discharge port 63 where it is forced out of the pump by the meshing of the gears. It can be seen that if air enters the space between the gears at the suction port, the pump will lose efficiency and cause a resultant delay or lag in pressure build-up.

The present invention allows the pump internal diameter to accept air from the pressure side on start-up but removes the air before it can reach the suction side of the pump. At the same time, the present invention does not compromise pump output under normal operations.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A transmission system for diverting air inside a transmission, said system comprising:

a transmission pump attached to a transmission housing, said pump having a discharge side, a suction side and an internal diameter portion; and an air pressure discharge device having an entrance positioned at said internal diameter portion of said transmission pump for diverting air from said internal diameter portion to thereby prevent air from entering the suction side of said pump.

2. The system according to claim 1, wherein said air pressure discharge device is a ball check valve arrangement.

3. The transmission system according to claim 1, wherein said air diverted from said transmission pump is fed to a non-fluid portion of said transmission.

4. The system according to claim 1, wherein said air pressure discharge device is dimensioned to allow passage of air but not passage of transmission fluid.

5. The system according to claim 1, wherein the discharge device further includes a device to prevent air from entering the internal diameter portion during shutdown.

6. A system according to claim 5 wherein the device to prevent air entering is a ball check valve.

7. A device for removing air from an internal diameter portion of a transmission pump on a vehicle, said device comprising:

a discharge device having an input in fluid communication with an internal diameter of said transmission pump;

an air relief valve controllably outputting air received from said internal diameter of the transmission pump wherein said air relief valve includes a means for blocking passage of transmission fluid received from an output of said internal diameter of the transmission pump.

8. The device according to claim 7, wherein said transmission pump is a gear pump.

9. The system according to claim 1, wherein said air originates in a torque converter during shutdown of a vehicle and wherein said air escapes through a spacing between said transmission pump and a housing structure of said transmission during start up of said vehicle.

10. The system according to claim 7, wherein said air originates in a torque converter during shutdown of a vehicle and wherein said air escapes through a spacing between said transmission pump and a housing structure of said transmission during start up of said vehicle.

* * * * *